US005188449A

United States Patent [19]

Davis et al.

[11] Patent Number: 5,188,449

[45] Date of Patent: Feb. 23, 1993

[54] LIGHTING FIXTURE ASSEMBLY

[75] Inventors: Scott A. Davis, Kingstown; Jan W. Uryase, Coventry, both of R.I.

[73] Assignee: Architectural Lighting Systems Inc., Taunton, Mass.

[21] Appl. No.: 645,125

[22] Filed: Jan. 24, 1991

[51] Int. Cl.[5] ..... F21S 3/04

[52] U.S. Cl. ..... 362/148; 362/150; 362/225; 362/260; 362/404

[58] Field of Search ..... 362/217, 219, 225, 227, 362/249, 367, 368, 404, 147, 148, 150, 260

[56] References Cited

U.S. PATENT DOCUMENTS 2,065,626 12/1936 Stone ..... 362/225
2,616,028 10/1952 Wiles ..... 362/225
4,175,281 11/1979 Lonseth ..... 362/368
4,186,433 1/1980 Baldwin ..... 362/404
4,520,436 5/1985 McNair et al. ..... 362/225
4,768,140 8/1988 Szpur ..... 362/367

*Primary Examiner*—Richard R. Cole
*Attorney, Agent, or Firm*—Gottlieb, Rackman & Reisman

[57] ABSTRACT

A lighting fixture assembly is provided which includes the possible use of multiple types of fixture fittings, a light fixture which allows for multi-directional lighting, pendants and a reflecting surface which is preferably a ceiling panel having a reflecting face. The lighting fixture assembly can be assembled into a uniform assembly so as to be easily attachable and detachable from a hung-ceiling.

52 Claims, 6 Drawing Sheets

LIGHTING FIXTURE ASSEMBLY

BACKGROUND

This invention relates to a lighting fixture assembly, and more particularly, to a lighting fixture assembly which lights the area below it from many directions, is capable of taking many different shapes, and which is uniformly attachable to a ceiling.

Lighting fixture assemblies are well known additions to most homes and offices within the United States. Specifically, lighting fixture assemblies which are suspended from ceilings or hung-ceilings have varied throughout history from vast ornate structures suspended in the halls of kings holding candles, to today's modern in-ceiling fluorescent light fixtures.

The above mentioned prior art lighting fixtures have had a number of common features. Of these common features, the most glaring inconveniences associated with these prior art lighting fixtures is the difficulty in installing or removing them, their singular method of directing light, and their failure to be adaptable to changing interior designs of the office, conference hall or home in which they are installed.

Accordingly, it would be desirable to provide a lighting fixture assembly that overcomes the disadvantages of the prior art lighting fixtures by allowing easy installation and removal, by providing multi-directional lighting, and by providing a lighting fixture assembly which is cost effective in that only one part of the assembly would have to be replaced or altered if the interior design of the office, conference hall or home were changed.

SUMMARY OF THE INVENTION

Generally speaking, in accordance with the invention, an improved lighting fixture assembly is provided. The lighting fixture assembly of the invention includes the possible use of multiple types of fixture fittings, a light fixture which allows for multi-directional lighting, pendants and a reflecting surface which is preferably a ceiling panel having a reflecting face. The lighting fixture assembly can be assembled into a uniform assembly so as to be easily attachable and detachable from a hung-ceiling.

There are many different designs of fixture fittings which may be used with the lighting fixture assembly. Each of these fixture fittings have an upwardly extending inner frame and a shell surrounding the inner frame. The inner frame defines an aperture which is substantially, centrally located. A translucent cover may be suspended within the aperture which may or may not diffuse light.

The light fixture of the invention is a substantially rectangularly shaped unit having an opening located substantially at its center. The opening is defined by a series of interconnected splice chambers. Each of the splice chambers has an inner wall, an outer wall and an upper wall. A series of lamps are mounted to the outer walls of the splice chambers. Surrounding the lamps is an outer rectangular enclosure comprised of a series of reflective panels each having a reflective face.

The inner frame of the fixture fitting is received through the opening in the light fixture. The inner frame of the fixture fitting is releasably secured to the light fixture by securing means mounted on the upper walls of the splice chambers.

The lighting fixture assembly of the invention is also uniformly attachable or detachable from a hung-ceiling. In this regard, the light fixture is attached to a ceiling panel by a plurality of pendants. Each pendant is preferably a hollow tubular member capable of receiving therethrough electrical wires. These electrical wires supply the electricity from the building to the series of lamps.

The ceiling panel is manufactured to fit the hung-ceiling and has an upper splice chamber for connecting the electrical wires from the pendant to the electricity supply of the building. The ceiling panel has a reflecting face which is visible when the lighting fixture assembly is installed.

The lighting fixture assembly is a unitarily installed unit. Accordingly, the light fixture is received within the chosen fixture fitting and releasably secured thereto, and the pendants attach the ceiling panel to the light fixture. In this way, the entire assembly is attachable and detachable from the hung-ceiling.

Accordingly, the light from the series of lamps is reflected off of the reflective faces of the series of reflective panels in outward directions away from the aperture of the lighting fixture assembly. Each of these outward directions is a quadrant configuration. Accordingly, each lamp of the series of lamps provides light in only one specific quadrant of the total area illuminated by the lighting fixture assembly.

Further, the light from the series of lamps is also reflected off of the reflecting face of the ceiling panel and down through the aperture in the lighting fixture assembly. Since the lighting fixture assembly supplies light outward from the light fixture and down through the aperture in the center of the assembly, the lighting fixture assembly supplies multi-directional lighting.

Accordingly, it is an object of the invention to provide an improved lighting fixture assembly.

Still another object of the invention is to provide a lighting fixture assembly which has easily interchangeable fixture fittings.

Still a further object of the invention is to provide a lighting fixture assembly with fixture fittings that may be easily painted and repainted so as to remain aesthetically pleasing and to remain color coordinated with its surroundings.

Another object of the invention is to provide a lighting fixture assembly which directs light in multiple directions.

Still another object of the invention is to provide light directed out from the assembly, whereby each lamp lights only one quadrant of the total area illuminated by the lighting fixture assembly.

Yet another object of the invention is to provide a lighting fixture assembly which can be fully assembled before placement onto a hung-ceiling.

Yet a further object of the invention is to provide a lighting fixture assembly which is easily attachable and detachable to a hung-ceiling.

Other objects of the invention will in part be obvious and will in part be apparent from the following description.

The invention accordingly comprises an assembly possessing the features, properties, and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
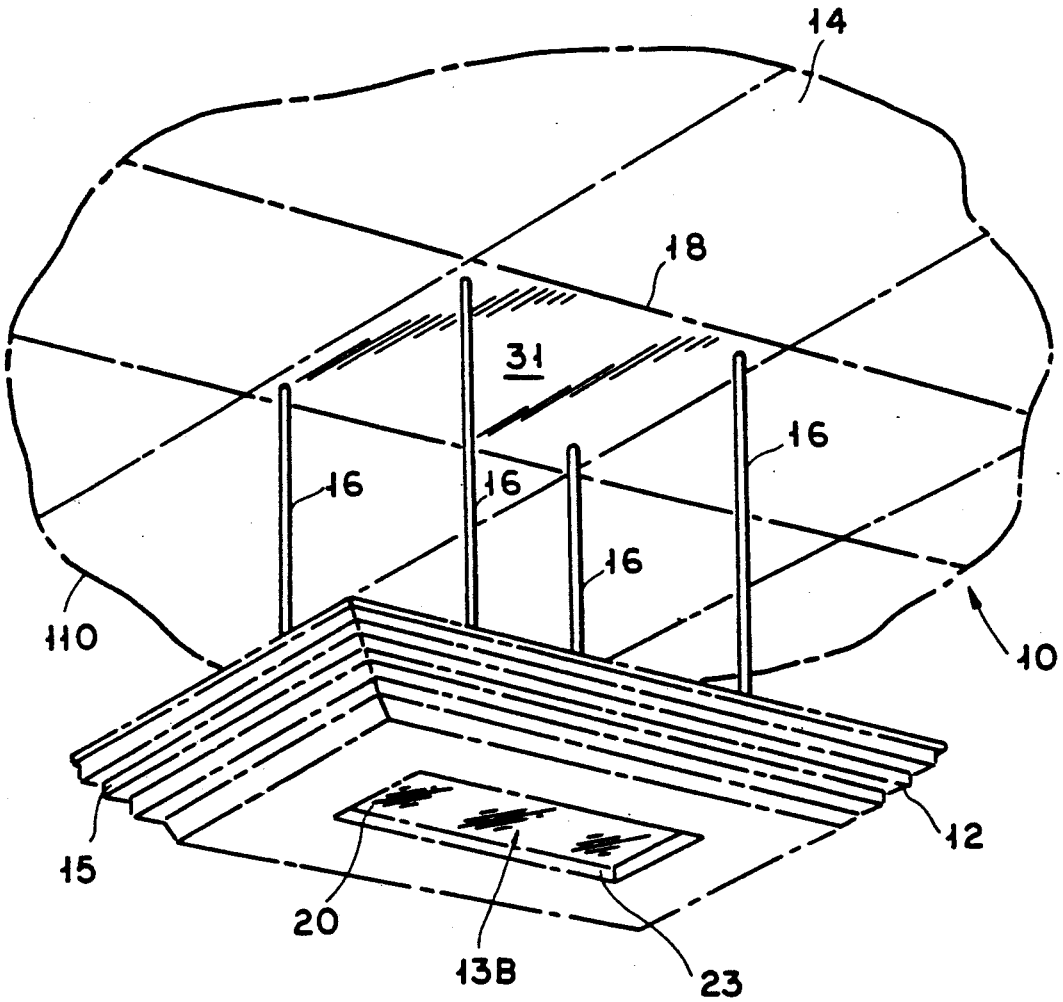
FIG. 1 is a perspective view of a lighting fixture assembly in accordance with the invention.
Figure 2:
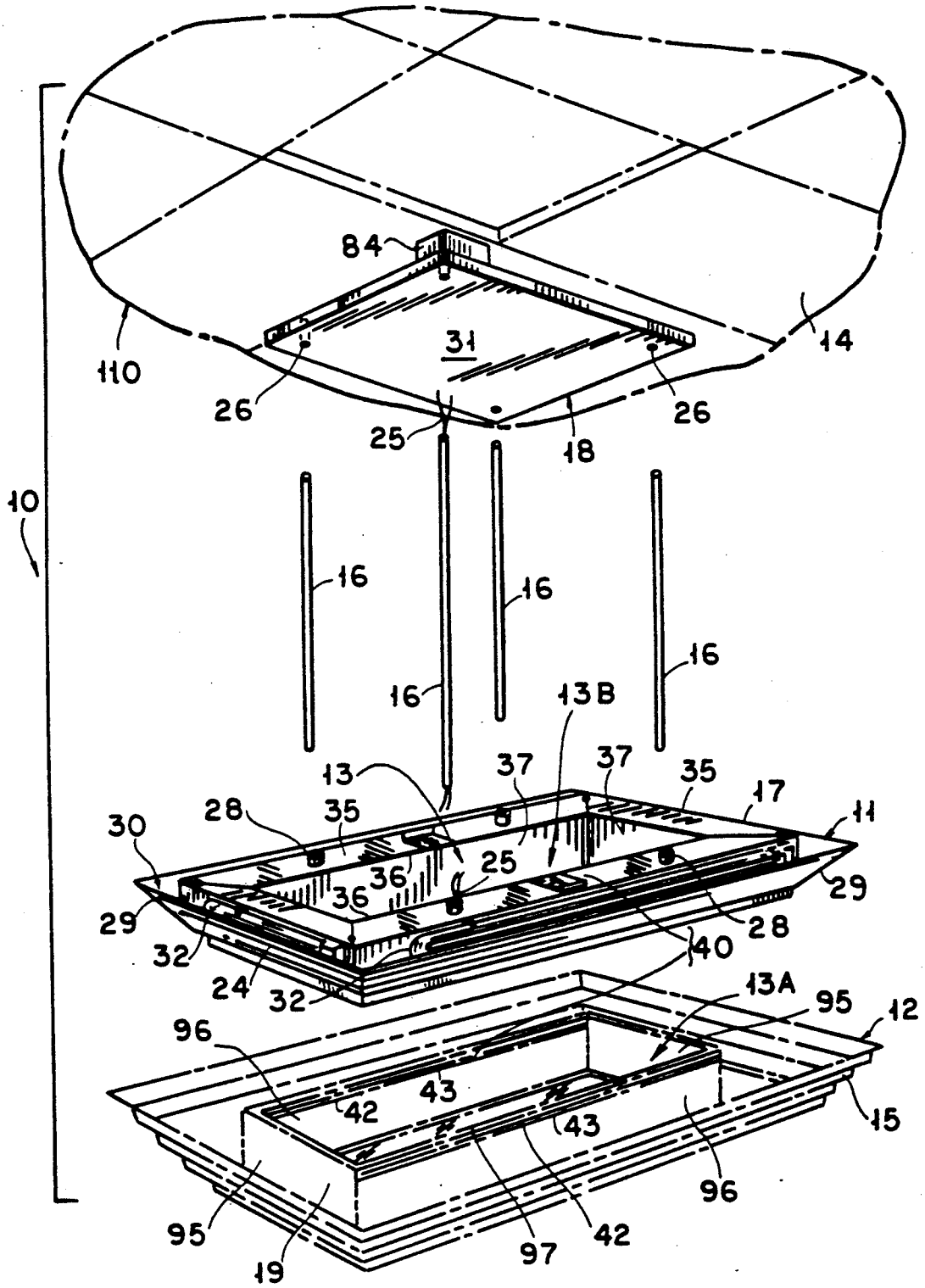
FIG. 2 is an exploded perspective view of the lighting fixture assembly of FIG. 1.

Referring first to FIGS. 1 and 2, a lighting fixture assembly made in accordance with the invention and generally designated at 10 is illustrated. Lighting fixture assembly 10 includes a light fixture 11, a fixture fitting 12, pendants 16 and a reflecting surface 110 which is preferably a ceiling panel 18 having a reflecting face 31.

Light fixture 11, as shown in FIG. 2, is of a substantially rectangular shape. Light fixture 11 has an upwardly extending inner enclosure 17. Inner enclosure 17 is comprised of four splice chambers 35 for defining an opening 13 through light fixture 11 which is centrally located. Splice chambers 35 are interconnected to each other and have splice chamber covers 36. Splice chamber covers 36 have inner walls 37, outer-opposite walls 38 and upper walls 39. Upper walls 39 connect inner walls 37 with outer walls 38.

Figure 3:
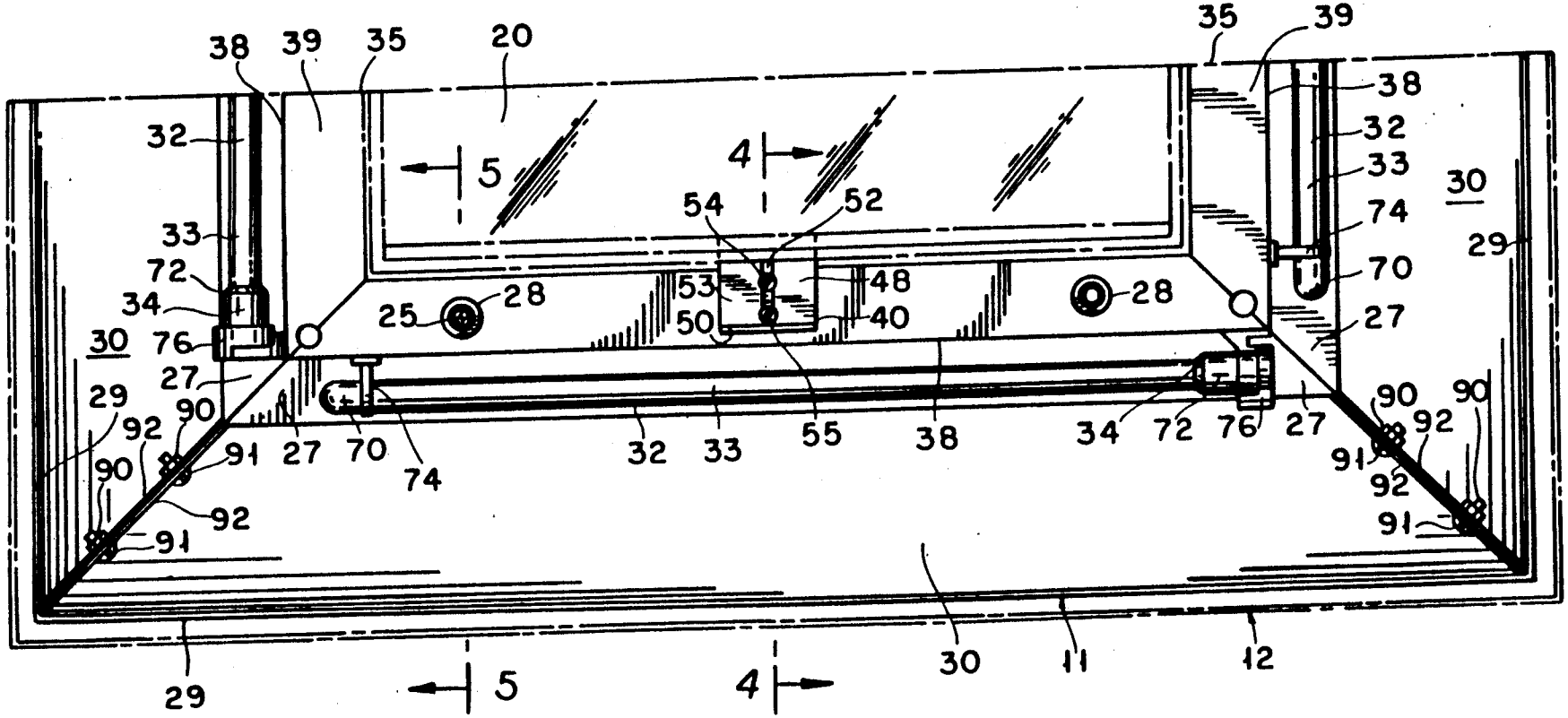
FIG. 3 is a top plan view of the lighting fixture assembly of FIG. 1.

As seen in FIG. 3, connected to outer walls 38 of each of splice chambers 35, are a series of lamps 32. Lamps 32 have lighting members 33 and plugs 34. Lighting members 33 are "U"-shaped and have upper bulb sections 80 and lower bulb sections 82, see FIGS. 3, 4 and 5. This "U"-shaped configuration of lamps 32 is more specifically referred to as bi-axial. As will be discussed in more detail below, the bi-axial nature of lamps 32 contribute to the multi-directional lighting of lighting fixture assembly 10.

Figure 5:
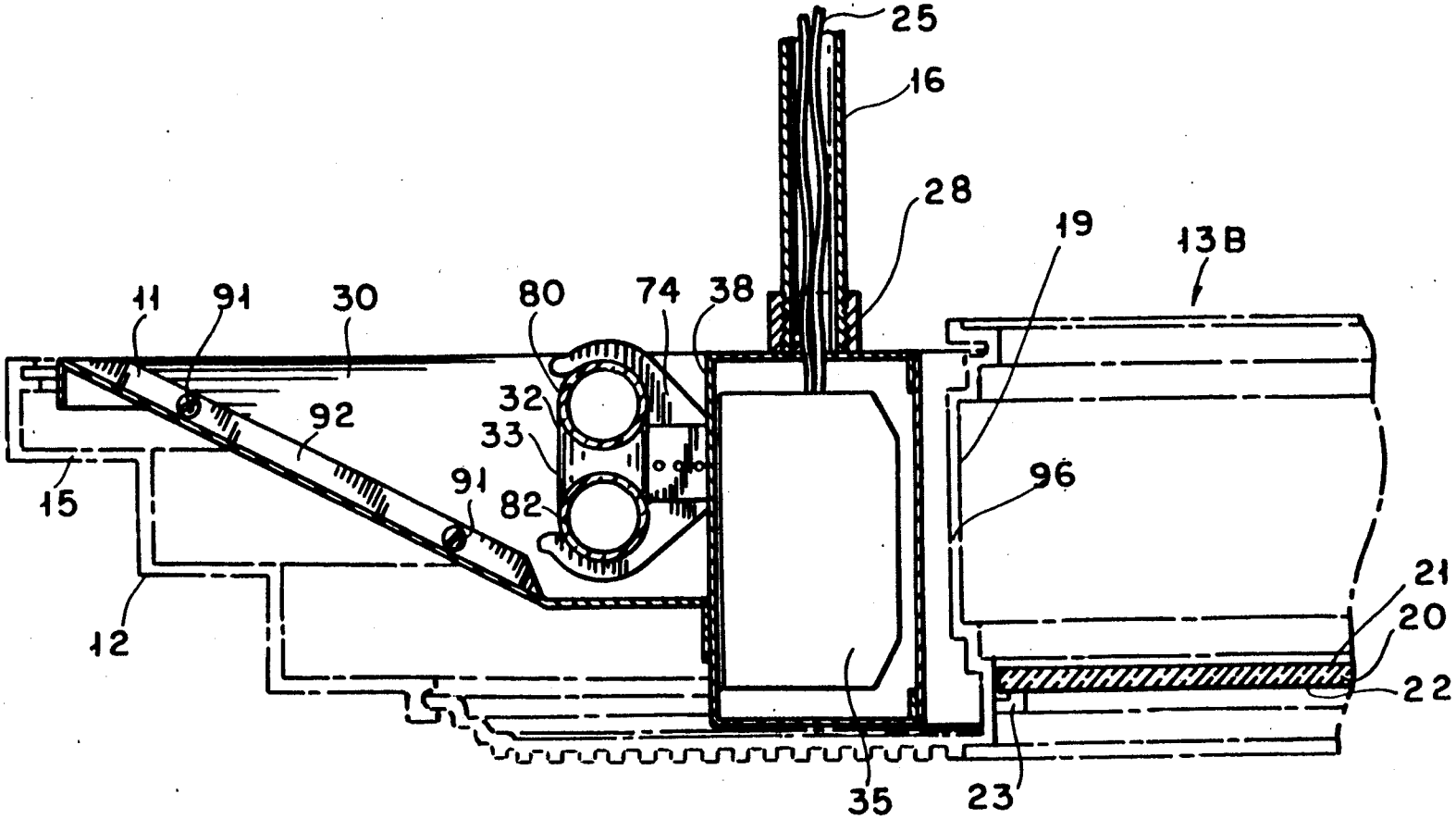
FIG. 5 is a cross-sectional view taken along line 5—5 of FIG. 3.

As is shown most clearly in FIGS. 3 and 5, lighting members 33 have first ends 70 near the bend in their "U"-shaped configuration. First ends 70 are mounted to outer walls 38 of splice chambers 35 by lamp aligners 74. Lamp aligners 74 are pluggingly mounted on outer walls 38 and are accordingly removable.

Figure 4:
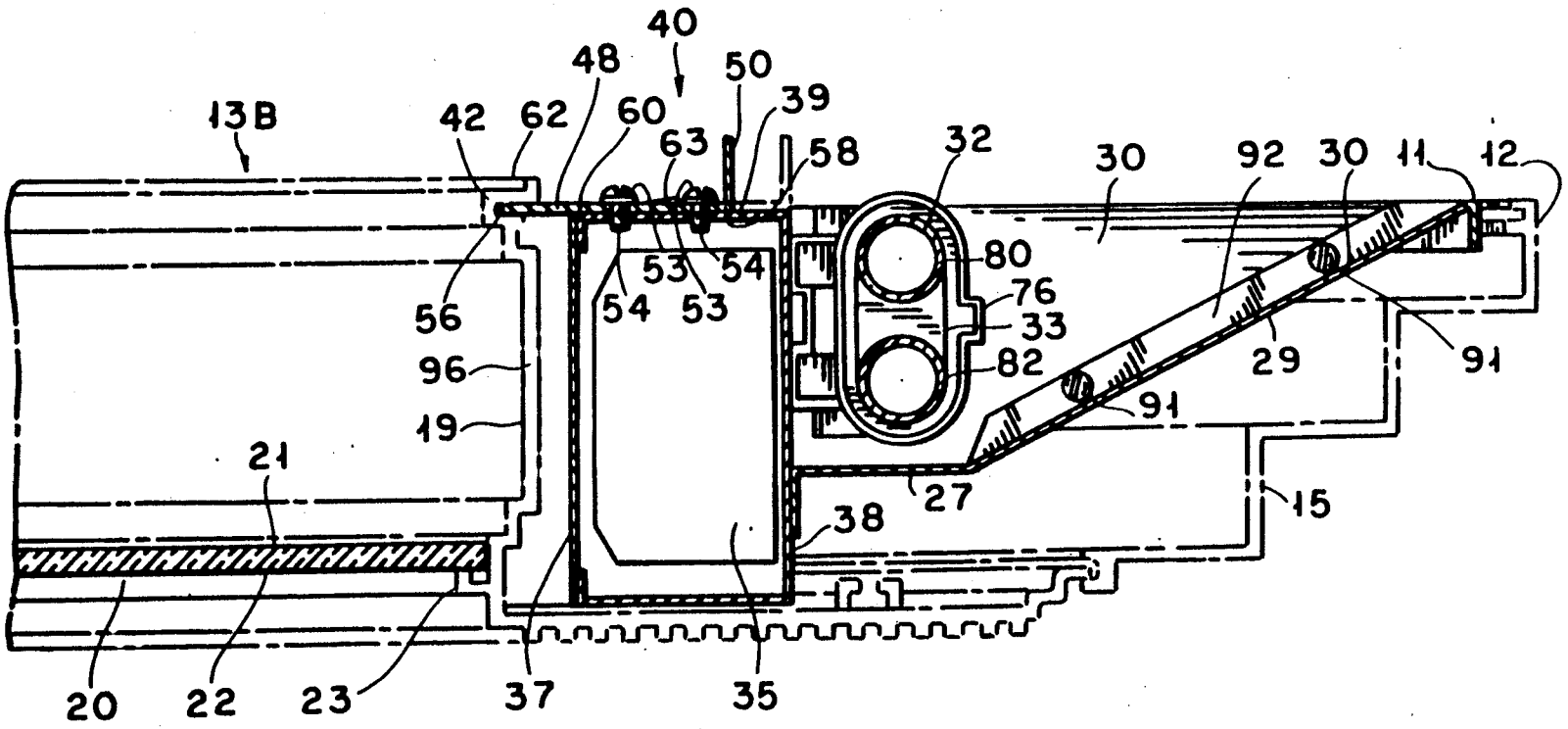
FIG. 4 is a cross-sectional view taken along line 4—4 of FIG. 3.

Turning now to FIGS. 3 and 4, lamps 32 have plugs 34. Plugs 34 are located at second ends 72 of lamps 32. Second ends 72 are the "open" end of "U"-shaped lighting members 33. Accordingly, plugs 34 close the opening at second ends 72 of lamps 32 in "U"-shaped member 33.

As shown in FIGS. 3 and 4, plugs 34 are adapted to be received within lamp holders 76. Lamp holders 76 are attached to outer walls 38 of splice chamber covers 36 by screws (not shown). Lamp holders 76 have sockets (not shown) for receiving plugs 34. The sockets have electrical wires (not shown) which are received into splice chambers 35 through holes (not shown) in outer walls 38. The electrical wires from each of the sockets are connected within splice chambers 35 (not shown) so that only one set of electrical wires 25 (see FIGS. 2, 3 and 5) are received through one of pendants 16, as will be discussed more completely below.

Continuing with FIGS. 2 and 3, light fixture 11 further includes an outer enclosure 24. Outer enclosure 24 comprises a series of reflective panels 29. Reflective panels 29 define the outer rectangular dimensions of light fixture 11 and surround lamps 32 and splice chambers 35. Reflective panels 29 consist of reflective faces 30 extending angularly away from lamps 32 (see FIGS. 2, 3 and 4). Accordingly, if viewed from below, an observer would see a rectangular light fixture 11 with an opening 13 through its center.

The rectangular shape of light fixture 11, which is dictated by both the configuration of splice chambers 35 and reflective panels 29, is specifically related to the ability of lighting fixture assembly 10 to provide multi-directional lighting. As will be discussed more completely below, each of lamps 32 directs light in substantially two directions; outward away from opening 13 of light fixture 11 and down through opening 13. The outward directed light from each of lamps 32 lights only one quadrant of the total area illuminated by all of the outward directed light from all of lamps 32. This innovative design of light fixture 11 increases the outward illumination produced by lighting fixture assembly 10 because the light from each of lamps 32 is concentrated to only one area outside of light fixture 11. Additionally, there is only a very limited overlap area of illumination from each of lamps 32. The advantage of having limited overlap illumination is that a more uniform distribution of light away from lighting fixture assembly 10 is achieved.

Continuing with FIGS. 3, 4 and 5, reflective panels 29 are attached to outer walls 38 of splice chamber covers 36 by platforms 27. Platforms 27 are substantially horizontal and are located below lamps 32. Platforms 27 are attached to outer walls 38 by rivets (not shown).

As is also shown in FIGS. 3, 4 and 5, reflective panels 29 are interconnected at their ends by nuts 90 and bolts 91. Each end of reflective panels 29 have raised partitions 92. Partitions 92 have holes (not shown) through which bolts 91 protrude. Accordingly, nuts 90 are tightened around bolts 91 so that partitions 92 are secured to each other.

As shown in FIG. 2, fixture fitting 12 comprises a shell 15 which is adapted to be received around reflective panels 29 of light fixture 11. Fixture fitting 12 further comprises an upwardly extending, inwardly located rectangular frame 19. Inner frame 19 defines an aperture 13A and is received within opening 13 of light fixture 11. When aperture 13A of fixture fitting 12 is received within opening 13 of light fixture 11, a new opening 13B of lighting fixture assembly 10 is defined (see FIGS. 1 and 2).

Inner frame 19 has vertical members 95 and 96 which are in facing relation with inner walls 37 of splice chamber covers 36 when inner frame 19 of fixture fitting 12 is received within opening 13 of light fixture 11. Members 95 are the short sides of rectangular inner frame 19, while members 96 are the long sides of rectangular inner frame 19. As will be discussed below, upper edges 97 of members 96 have pockets 42 or slits 43 which are part of securing means 40 for receiving horizontal plates 48 of securing means 40.

Still referring to FIG. 2, fixture fitting 12 is preferably made of plastic, but may be also made of metal. Additionally, shell 15 of fixture fitting 12 may be constructed in many different shapes and designs; i.e., oval, without the ridges, smooth, etc. Shell 15 may also be painted and repainted. Accordingly, since either the shape, style or color of shell 15 of fixture fitting 12 may be economically varied, using lighting fixture assembly 10 allows for economical and easy ways to adapt the lighting units of an office, conference room or home to changes in the room's interior design.

Continuing with FIG. 2, pendants 16 of the inventive lighting fixture assembly 10 are shown attached to nuts 28 located on upper walls 39 of splice chamber covers 36. Pendants 16 are hollow tubular members with threaded ends for screwing them into nuts 28 on light fixture 11 and through holes 26 in ceiling panel 18. Additionally, pendants 16 are hollow in order to receive electrical wires 25 therethrough from splice chambers 35. As previously discussed, electrical wires 25 bring the electricity from the building to lamps 32.

As shown in FIG. 2, and as is preferred, only one of pendants 16 will normally receive electrical wires 25 therethrough. This is because attached above ceiling panel 18 is an upper splice chamber 84 which receives electrical wires 25 from only one of pendants 16. Upper splice chamber 84 is designed to be easily connectable and unconnectable to the electrical system of the building. Therefore, the benefit of having to have only one upper splice chamber 84 with a connection portal (not shown) to the building electrical system is evident when consideration is made as to the ease of removal or installation of lighting fixture assembly 10 into hung-ceiling 14.

Ceiling panel 18 can be manufactured to fit the design of hung-ceiling 14 which is specifically chosen for the room in which lighting fixture assembly 10 is installed. Accordingly, although the spacing of pendants 16 will be dictated by the weight and dimensions of light fixture 11 and fixture fitting 12, ceiling panel 18 can take almost any form.

Continuing with FIGS. 1 and 2, the surface of ceiling panel 18 which is visible when lighting fixture assembly 10 is used, is a reflecting face 31 for directing light down through opening 13B of lighting fixture assembly 10. Accordingly, light from upper bulb sections 80 of lamps 32 (discussed above) is directed off of reflecting face 31 of ceiling panel 18 and down through opening 13B so that it seems as if a central lamp is being used to direct light down through lighting fixture assembly 10. As has been discussed above, light from lamps 32 is also reflected out from lighting fixture assembly 10 and away from opening 13B of lighting fixture assembly 10 by reflective panels 29. In this way, lighting fixture assembly 10 is capable of supplying light to the room from multiple directions; i.e., the quadrant lighting of each of lamps 32 and the down lighting through opening 13B.

In addition to lighting fixture assembly 10 being able to direct light down through opening 13B due to reflection of light from lamps 32 off of reflecting face 31 of ceiling panel 18, light can also be reflected off of a non-hung ceiling (not shown) and down through opening 13B. In this sense, the non-hung ceiling is reflecting surface 110. Accordingly, the inventive multi-directional lighting capability of lighting fixture assembly 10 is retained when lighting fixture assembly 10 is used with a non-hung ceiling.

When lighting fixture assembly is used with a non-hung ceiling, ceiling panel 18 is not used. Instead a steel plate (not shown) can be attached to the non-hung ceiling. The plate can be installed either above or below the ceiling. If the plate is above the ceiling, pendants 16 will be secured to it through holes drilled into the ceiling (not shown). In this case, reflecting surface 110 is on the ceiling itself. Further, if the plate is below the ceiling, the plate is covered with a canopy (not shown). The canopy then acts as reflecting surface 110.

Additionally, pendants 16 can be cables (not shown). The cables are not hollow. If pendants 16 are cables, the electrical wires 25 are not received through one of pendants 16, as discussed above, but around pendant 16. The electrical wires would in this instance preferably be insulated in a retractable cord.

Figure 6:
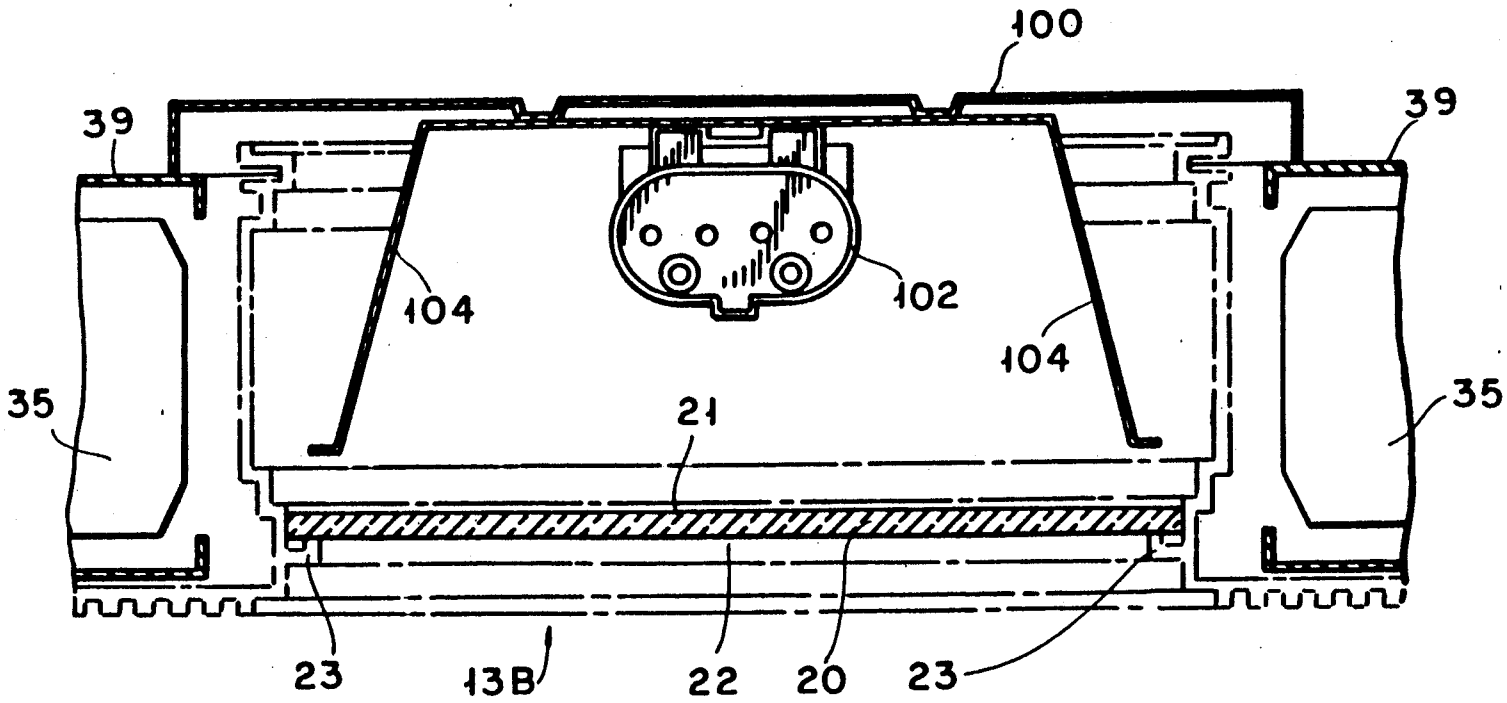
FIG. 6 is an alternate cross-sectional view taken through the light fixture showing the use of a downlite assembly.

Turning our attention to FIG. 6, light can be directed down through opening 13B by the use of optional downlite assembly 100. Downlite assembly 100 is designed to enclose opening 13B by resting upon upper walls 39 of splice chamber covers 36. Downlite assembly 100 has at least one lamp 102 which can be either uniaxial, bi-axial or any combination of the above. Downlite assembly 100 also has reflective sides 104 to direct the light from lamp 102 down through opening 13B. The use of downlite assembly 100 provides direct lighting through opening 13B.

Additionally, lighting fixture assembly 10 is provided with an extra on/off switch (not shown) for downlite assembly 100 which is separate and apart from the on/-off switch (not shown) for lamps 32. Accordingly, lamps 32 and lamp 102 may be lit together or individually. If downlite assembly 100 is used, another of pendants 16 receives the electrical wires (not shown) associated with downlite assembly 100. Accordingly, an extra upper splice chamber (not shown) is also needed.

Turning back to FIGS. 1 and 2, the amount of light directed off of reflecting face 31 of ceiling panel 18 will ultimately depend upon the length of pendants 16, and therefore the distance of light fixture 11 from ceiling panel 18. Accordingly, pendants 16 are manufactured according to specification in order to supply the amount of light down through opening 13B sought by the user of the building.

Turning now to FIGS. 3 and 4, the mechanisms for securing fixture fitting 12 to light fixture 11 are shown. Specifically, securing means 40 comprise horizontal plates 48 which are movably attached to upper walls 39 of splice chamber covers 36. Each of horizontal plates 48 is movable between a first position 60 (as shown in phantom in FIG. 4) and a second position 62 (shown in FIG. 4). Securing means 40 further comprises pockets 42 in upper edges 97 of vertical members 96 of inner frame 19 of fixture fitting 12 (as was discussed above). In order to releasably secure fixture fitting 12 to light fixture 11, a first end 56 of horizontal plate 48 is slid from first position 60, which is a position wherein horizontal plate 48 is fully located on upper wall 39 of splice chamber cover 36, to second position 62, which is a position wherein first end 56 of horizontal plate 48 is off of upper wall 39 and within pocket 42.

Horizontal plate 48 is slid between first and second positions 60 and 62, respectively, by a vertical plate 50. Vertical plate 50 is attached in a substantially perpendicular manner to a second end 58 of horizontal plate 48 (see FIGS. 3 and 4).

Horizontal plate 48 is releasably secured to upper wall 39 of splice chamber cover 36 by fastening means 53. Fastening means 53 comprise screws 54 inserted through a slot 52 in horizontal plate 48. Screws 54 have heads 55 which are larger in diameter than the width of slot 52. Accordingly, horizontal plate 48 is releasably secured to upper wall 39 of splice chamber cover 36 when screws 54 are tightened.

Additionally, as seen in FIG. 4, slot 52 of horizontal plate 48 has a raised stop 63 which maintains proper spacing of screws 54 so that they do not end up right next to each other on horizontal plate 48. This assures that the proper stresses are maintained within screws 54. Stop 63 also prevents horizontal plate 48 from being accidentally removed from upper wall 39 when horizontal plate 48 is slid between first and second positions 60 and 62, respectfully.

Since horizontal plate 48 is able to slide from its first position 60 to its second position 62 and back again, fixture fitting 12 is removable from light fixture 11. Therefore, in order to change, replace or fix fixture fitting 12, one need only loosen fastening means 53, slide horizontal plate 48 from second position 62 to first position 60 and then remove fixture fitting 12. Horizontal plate 48 should then be secured to upper wall 39 of splice chamber cover 36 by tightening screws 54 of fastening means 53. Accordingly, when a new or repaired fixture fitting 12 is ready to be placed onto light fixture 11, the reverse procedure is performed. This procedure can be done while lighting fixture assembly 10 is suspended from hung-ceiling 14 or is on a working surface (not shown) such as a floor.

As was discussed above, and as seen in FIG. 2, pockets 42 are located at edge 97 of vertical members 96 of inner frame 19 of fixture fitting 12. Pockets 42 are designed to create an area where first ends 56 of horizontal plates 48 can go so as to support fixture fitting 12 on light fixture 11. Alternatively, as shown in FIG. 2, instead of pockets 42, slits 43 may be inserted near edge 97 of inner frame 19. Accordingly, if slits 43 are used, first ends 56 of horizontal plates 48 protrude through slits 43 to support fixture fitting 12 on light fixture 11.

Continuing with FIGS. 1 and 4, fixture fitting 12 may have a translucent cover 20. Translucent cover 20 is supported along a ledge 23 extending from members 95 and 96 of inner frame 19. Translucent cover 20 is inserted in a downward direction through aperture 13A of fixture fitting 12 so as to be supported on ledge 23. Translucent cover 20 may have means for diffusing the light (not shown) reflected off of reflecting face 31 of ceiling panel 18 or the light from downlite assembly 100. The diffusing means may be a film (not shown) or a texturing (not shown) of top surface 21 and/or bottom surface 22 of translucent cover 20.

As has been discussed, the vertically aligned upper bulb sections 80 and lower bulb sections 82 of bi-axial lamps 32 are designed to provide lighting to a room from multiple directions. In essence, light from both upper bulb sections 80 and lower bulb sections 82 is reflected off of reflective faces 30 of reflective panels 29 and out over the sides of fixture fitting 12 to illuminate the area around and underneath lighting fixture assembly 10. In addition, light solely from upper bulb sections 80 of lamps 32 is directed upward towards ceiling panel 18 so that it is then directed downward by reflecting face 31 of ceiling panel 18 and through aperture 13B in the center of lighting fixture assembly 10. Accordingly, lighting fixture assembly 10 provides multi-directional lighting because light appears to be coming directly from the center of lighting fixture assembly 10 through aperture 13B and from the sides of lighting fixture assembly 10.

It will thus be seen that the objects set forth above, among those made apparent from the proceeding description, are efficiently obtained and, since certain changes may be made in the above assembly without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A lighting fixture assembly, comprising:

a light fixture having an opening formed therein;

a light fixture fitting adapted to be mounted below said light fixture having an upwardly extending inner frame defining an aperture for receipt within said light fixture opening;

means for supporting said fixture fitting when said inner frame of said fixture fitting is received within said light fixture opening comprising means for releasably securing said light fixture to said inner frame of said fixture fitting, said securing means comprising slide means integrated with said light fixture for sliding in a direction toward said light fixture opening from a first non-securing position to a second securing position.

2. A lighting fixture assembly as recited in claim 1, wherein said slide means comprises at least two substantially horizontal plates mounted on said light fixture adjacent to said opening and adapted to slide from first positions whereby said horizontal plates are located entirely over said light fixture to second positions whereby said horizontal plates extend past said light fixture and into said opening.

3. A lighting fixture assembly as recited in claim 2, wherein said slide means further comprises pockets in said upwardly extending inner frame of said fixture fitting for receipt of said horizontal plates when said horizontal plates are in said second positions.

4. A lighting fixture assembly as recited in claim 3, wherein each of said pockets is a slit.

5. A lighting fixture assembly as recited in claim 3, wherein said light fixture comprises a plurality of splice chambers, said splice chambers defining said opening.

6. A lighting fixture assembly as recited in claim 5, wherein each of said splice chambers has a splice chamber cover.

7. A lighting fixture assembly as recited in claim 6, wherein each of said horizontal plates are mounted to one of said splice chamber covers.

8. A lighting fixture assembly as recited in claim 7, wherein each of said horizontal plates of said slide means has a slot.

9. A lighting fixture assembly as recited in claim 8, wherein said horizontal plate further comprises a first end movable between said first position on said splice chamber cover to said second position off of said splice chamber cover and received within said pocket.

10. A lighting fixture assembly as recited in claim 9, further comprising means for fastening said horizontal plate to said splice chamber cover in either said first or second positions.

11. A lighting fixture assembly as recited in claim 10, wherein said fastening means comprises a pair of screws received through both said slot of said horizontal plate and said splice chamber cover.

12. A lighting fixture assembly as recited in claim 11, wherein each of said screws has a head which is larger in diameter than the width of said slot so that said horizontal plate is fastened to said splice chamber cover in either said first or second positions when said screw head is tightened against said horizontal plate.

13. A lighting fixture assembly as recited in claim 11, wherein said slide means has means for pushing said horizontal plate between said first and second positions.

14. A lighting fixture assembly as recited in claim 13, wherein said pushing means is a substantially vertical plate attached to a second end of said horizontal plate.

15. A lighting fixture assembly a recited in claim 14, wherein said vertical plate is substantially perpendicular to said horizontal plate.

16. A lighting fixture system, comprising:

a light fixture comprising an outer enclosure having a series of reflective panels, an inner enclosure defining an opening and having an outer wall and a series of lamps mounted along said outer wall of said inner enclosure; and a reflecting surface located substantially above said enclosure opening of said light fixture;

wherein light emitted from said series of lamps is reflected off of said series of reflective panels in directions away from said opening and is also reflected off of said reflecting surface in a direction through said opening.

17. A lighting fixture system as recited in claim 16, wherein said inner enclosure is a series of splice chambers.

18. A lighting fixture system as recited in claim 17, wherein said opening is defined by an inner wall of each of said series of splice chambers.

19. A lighting fixture system as recited in claim 18, wherein each of said series of lamps has a lighting member and a plug.

20. A lighting fixture system as recited in claim 19, wherein said lighting member is a substantially "U"-shaped member having a first end away from said plug and a second end at said plug.

21. A lighting fixture system as recited in claim 20, wherein said first end of said lighting member is supported by a lamp aligner mounted on said outer wall of said series of splice chambers.

22. A lighting fixture system as recited in claim 21, wherein said plug of said lamp is selectively received within a lamp holder.

23. A lighting fixture system as recited in claim 22, wherein said lamp holder has a lamp socket therein for selectively receiving said plug of said lamp.

24. A lighting fixture system as recited in claim 23, wherein said lamp holder is attached to said outer wall of said series of splice chambers.

25. A lighting fixture system as recited in claim 24, wherein each of said lighting members of said series of lamps is bi-axial.

26. A lighting fixture system as recited in claim 25, wherein each of said bi-axial lamps has an upper bulb section and a lower bulb section.

27. A lighting fixture system as recited in claim 26, wherein each of said reflective panels has a reflective face.

28. A lighting fixture system as recited in claim 27, wherein the light from said upper and lower bulb sections of said lighting members are reflected off of said reflective faces of said reflective panels and away from said light fixture opening.

29. A lighting fixture system as recited in claim 28, wherein said reflecting surface reflects light from said upper bulb sections of said lighting members down through said opening of said light fixture.

30. A lighting fixture system as recited in claim 28, wherein said light fixture further comprises a downlite assembly received within said opening of said light fixture.

31. A lighting fixture system as recited in claim 30, wherein said downlite assembly is supported within said opening by said upper sides of each of said splice chambers.

32. A lighting fixture system as recited in claim 31, wherein said downlite assembly has at least one lamp for directing light down through said opening.

33. A lighting fixture system as recited in claim 32, wherein said downlite assembly has reflective sides for reflecting light from said at least one lamp down through said opening.

34. A lighting fixture system as recited in claim 16, wherein said reflecting surface is a ceiling panel having a reflecting face.

35. A lighting fixture assembly for use in connection with a hung-ceiling, comprising:

a light fixture having an opening, a series of reflective panels and a series of lamps;

a fixture fitting releasably secured to said light fixture opening;

a ceiling panel adapted to be received by said hung-ceiling so that said ceiling panel is made integrally a part of said hung-ceiling; and means for attaching said light fixture to said panel;

wherein said lighting fixture assembly can be assembled into a uniform assembly for being secured, to said hung-ceiling in an integral manner therewith.

36. A lighting fixture assembly as recited in claim 35, wherein said fixture fitting can be a variety of fixture fittings.

37. A lighting fixture assembly as recited in claim 36, further comprising means for selectively securing any of said variety of fixture fittings to said light fixture.

38. A lighting fixture assembly as recited in claim 37, wherein said securing means comprises at least two substantially horizontal plates mounted on said light fixture adjacent to said opening and adapted to slide from first positions whereby said horizontal plates are located entirely over said light fixture to second positions whereby said horizontal plates extend past said light fixture and into said opening.

39. A lighting fixture assembly as recited in claim 38, wherein said securing means further comprises pockets in said fixture fitting for receipt of said horizontal plates when said horizontal plates are in said second positions.

40. A lighting fixture assembly as recited in claim 35, wherein each of said variety of fixture fittings has means for selectively supporting a translucent cover.

41. A lighting fixture assembly as recited in claim 40, wherein said supporting means is a ledge.

42. A lighting fixture assembly as recited in claim 41, wherein said translucent cover has means for defusing light.

43. A lighting fixture assembly as recited in claim 35, wherein said attaching means is a plurality of tubular members.

44. A lighting fixture assembly as recited in claim 43, wherein said plurality of tubular members are hollow.

45. A lighting fixture assembly as recited in claim 44, wherein said plurality of tubular members are pendants.

46. A lighting fixture assembly as recited in claim 44, wherein one of said hollow tubular members is adapted for receiving therethrough means for conducting electricity from said light fixture to said ceiling panel.

47. A lighting fixture assembly as recited in claim 46, wherein said conducting means are electrical wires.

48. A lighting fixture assembly as recited in claim 47, wherein said electrical wires are received through said ceiling panel into an upper splice chamber.

49. A method of installing a lighting fixture assembly having a fixture fitting, a light fixture, means for attaching said light fixture to said fixture fitting, a ceiling panel and an upper splice chamber, comprising the steps of:

connecting said attaching means to said light fixture;

attaching said ceiling panel to said attaching means;

running means for conducting electricity from said light fixture along one of said attaching means to said upper splice chamber; and lifting and tilting said lighting fixture assembly so that said ceiling panel is received by said hung-ceiling so that said ceiling panel is made integrally a part of said hung-ceiling.

50. The method of installing a lighting fixture assembly as recited in claim 49, further comprising the step of securing said fixture fitting to said light fixture before lighting said lighting fixture assembly onto said hung-ceiling.

51. A method of replacing fixture fittings of a lighting fixture assembly attached to a ceiling, wherein said lighting fixture assembly has a light fixture, a first fixture fitting and means for releasably securing said light fixture to said first fixture fitting wherein each of said securing means comprises a substantially horizontal member and means for receiving said substantially horizontal member, comprising the steps of:

removing said lighting fixture assembly from said ceiling;

removing said horizontal members of said securing means out from receiving means disposed in said first fixture fitting wherein said receiving means are pockets or slits in said first and second fixture fittings;

lifting said light fixture out from said first fixture fitting;

placing said light fixture into a second fixture fitting;

inserting said horizontal members into said receiving means disposed in said second fixture fitting; and lifting and tilting said lighting fixture assembly onto said ceiling.

52. A method of replacing fixture fittings of a lighting fixture assembly as recited in claim 51, wherein said horizontal members of said securing means are plates.

* * * * *